United States Patent [19]

Kindig

[11] Patent Number: 4,826,124

[45] Date of Patent: May 2, 1989

[54] EASEL WITH IMPROVED SHEET MATERIAL RETAINER

[75] Inventor: Omer L. Kindig, Warsaw, Ind.

[73] Assignee: Da-Lite Screen Co., Inc., Warsaw, Ind.

[21] Appl. No.: 143,803

[22] Filed: Jan. 14, 1988

[51] Int. Cl.[4] ..... A47B 97/04

[52] U.S. Cl. ..... 248/452; 16/349; 211/45; 211/89

[58] Field of Search ..... 248/452, 451, 453; 211/45, 89; 16/343, 349

[56] References Cited

U.S. PATENT DOCUMENTS

| | | | |
|---|---|---|---|
| 417,831 | 12/1889 | Munsell | 248/452 |
| 546,492 | 9/1895 | Millert | 211/45 X |
| 1,003,065 | 9/1911 | Plue | 16/343 |
| 1,290,652 | 1/1919 | Petrick | 211/45 |
| 2,511,546 | 6/1950 | Schwering | 16/343 X |
| 2,725,590 | 12/1955 | Ziegler | 16/343 |
| 3,046,595 | 7/1962 | Johansson et al. | 16/343 |

FOREIGN PATENT DOCUMENTS

| | | | |
|---|---|---|---|
| 2311182 | 9/1974 | Fed. Rep. of Germany | 211/46 |
| 2400867 | 7/1975 | Fed. Rep. of Germany | 211/45 |

*Primary Examiner*—J. Franklin Foss
*Assistant Examiner*—David L. Talbott
*Attorney, Agent, or Firm*—James D. Hall

[57] ABSTRACT

An easel having a leg supported panel at the upper margin of which sheet material is suspended. A hinged retainer is carried at the upper margin of the easel panel and is pivoted between a lowered position overlying the sheet material when the material is suspended from the panel and an upper or raised position to allow the sheet material to be removed or placed upon the panel. The retainer carries a pivotal locking member which when closed prevents the reatiner from being shifted from its lowered position into its raised position.

10 Claims, 2 Drawing Sheets

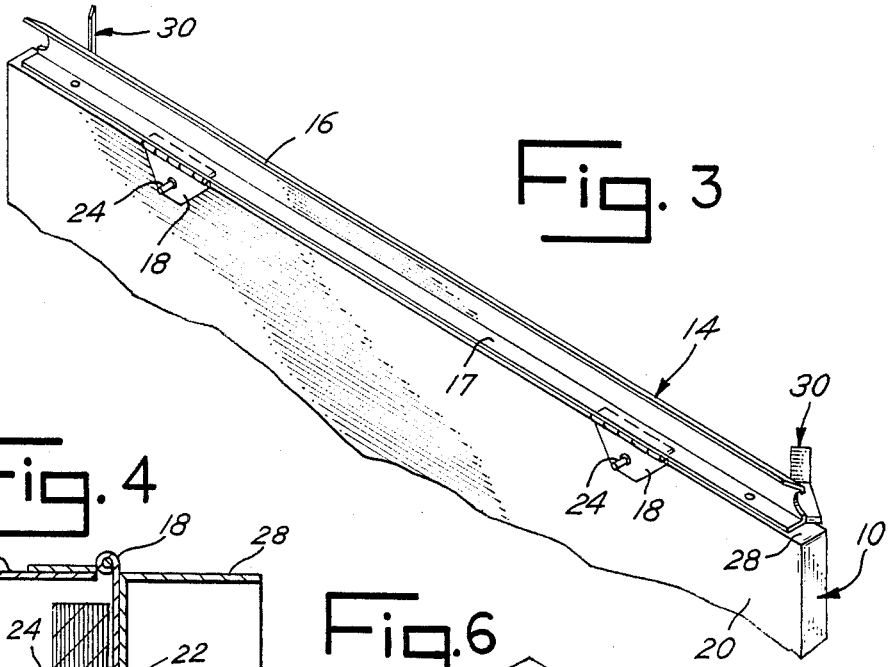
Fig. 3
Fig. 4
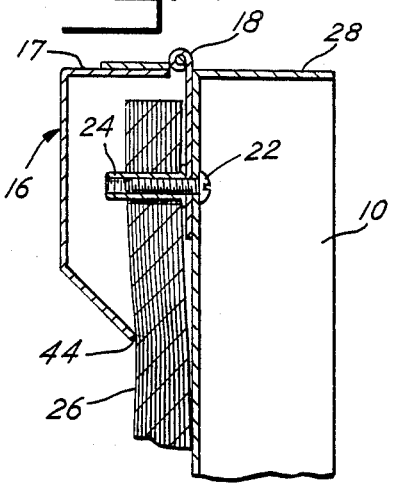
Fig. 6
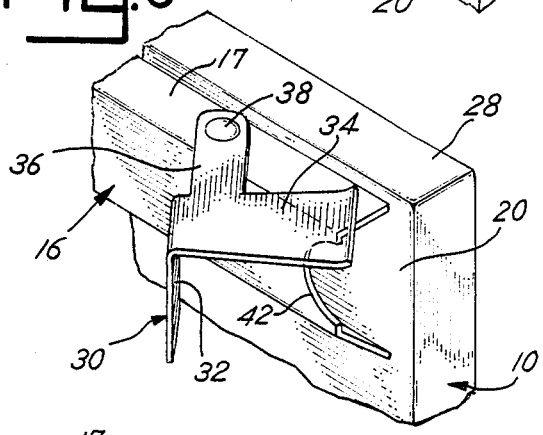
Fig. 7
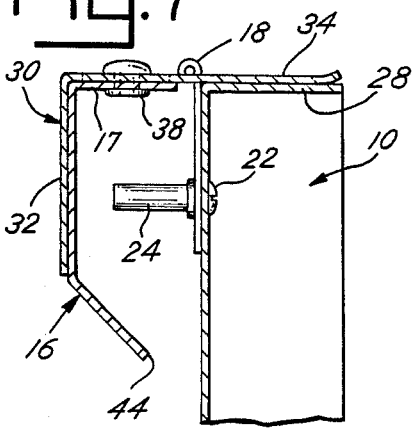
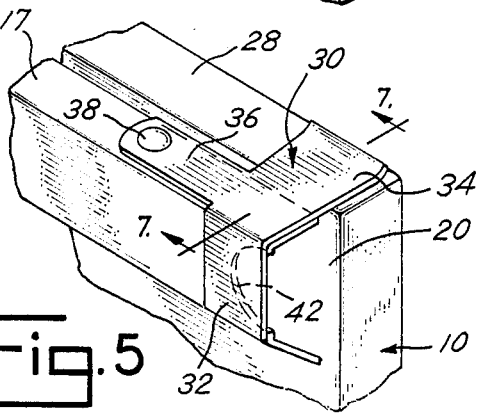
Fig. 5

EASEL WITH IMPROVED SHEET MATERIAL RETAINER

SUMMARY OF THE INVENTION

This invention relates to an improvement to an easel and will have specific application to the retainer for the sheet material which is suspended from the easel panel during easel usage.

Heretofore, easels have been constructed with spring-biased retainers which serve as a clamp for securing the sheet material, usually in the form of a paper pad or flip chart, to the panel of the easel. Difficulty with this type of construction has occurred in attempting with one hand to hold the retainer against its spring in an open position while with the other hand replacing or inserting the sheet material. In other easel constructions, the retainer is sometimes secured directly to the underlying easel panel by screws or other attachment means with the sheet material being suspended from the retainer or compressed between the retainer and the panel. Such previous methods of attaching the sheet material to the easel are cumbersome and time consuming.

In the following described invention, the retainer member which serves to anchor the sheet material is hinged to the panel of the easel so as to be freely pivotal from a lowered or down position overlying the sheet material and a raised or upper position which would expose the sheet material for removal from the support pins carried at the upper margin of the panel. A locking member is carried at one, and preferably both ends, of the retainer. Each locking member is pivotally connected to the retainer and can be shifted or swung into a closed or secured position which prevents the retainer from being raised from its down position into its upper position so as to expose the sheet material for replacement or removal. When it is desired to replace or remove the sheet material, each locking member is simply pivoted into its open position, which allows the retainer to be raised and the sheet material to be removed or replaced by both hands. In this manner, placement and removal of the sheet material can be accomplished in a simple and rapid manner.

Accordingly, it is an object of this invention to provide an easel in which the sheet material supported by the easel can be simply and rapidly attached and replaced.

Another object of this invention is to provide an easel having a retainer which overlies the upper margin of underlying removable sheet material and which can be simply and efficiently secured in its overlying position.

Still another object of this invention is to provide a retainer for sheet material, such as a paper pad, for use upon easels and which is of simple installation and efficient operation.

Other objects of this invention will become apparent upon the reading of the following description.

BRIEF DESCRIPTION OF THE DRAWINGS

A preferred embodiment of this invention has been chosen for purposes of illustration and description wherein:

FIG. 3 is a fragmentary perspective view of the easel showing the retainer in its open position with the sheet material removed.

FIG. 4 is a fragmentary sectional view taken along line 4—4 of FIG. 1 in which the retainer is in its closed position.

FIG. 5 is a fragmentary perspective view of a corner of the easel showing the retainer in its lowered and secured position with the sheet material removed for illustrative purposes.

FIG. 6 is a fragmentary perspective view like FIG. 5 but showing the retainer in a lowered but unsecured position.

FIG. 7 is a fragmentary sectional view taken along line 7—7 of FIG. 5.

DESCRIPTION OF THE PREFERRED EMBODIMENT

Figure 1:
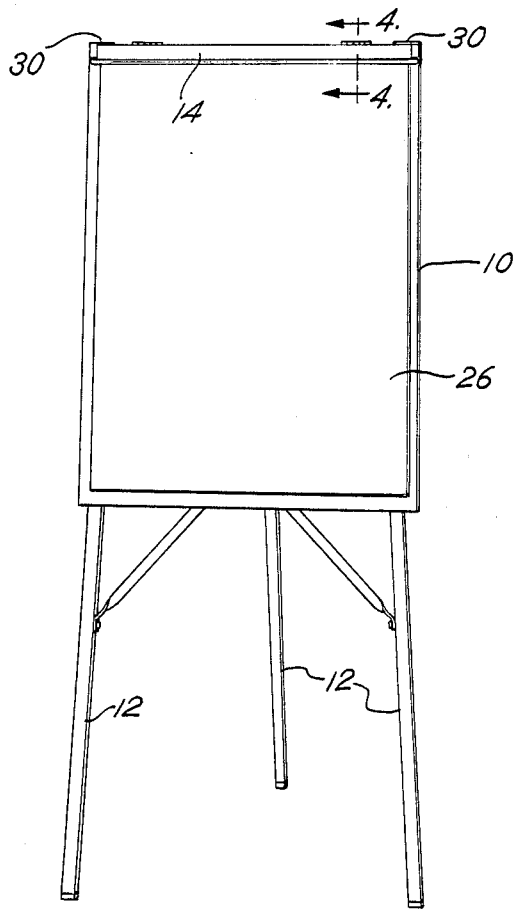
FIG. 1 is a perspective view of an easel incorporating the sheet material retainer of this invention.

The preferred embodiment illustrated is not intended to be exhaustive or to limit the invention to the precise form disclosed. It is chosen and described in order to explain the principles of the invention and their application and practical use so as to enable others skilled in the art to best utilize the invention.

The easel shown in the drawings includes a panel 10 which is

The easel shown in the drawings includes a panel 10 which is supported by a plurality of legs 12. The manner in which the panel and legs are connected is of common construction in the visual equipment field and form no novel part this invention. Normally, the rearwardly most leg is pivotally connected to the back of the panel so as to allow the leg to be swung inwardly into a vertical plane with regard to the remaining two legs for ease of storage of the easel. Attached along the upper margin 20 of panel 10 and preferably extending the full width of the panel is a retainer 14. Retainer 14 includes a channel part 16 which is of a general C-shaped configuration in cross-section and to which is connected two or more hinge parts 18. Each hinge part 18 has one of its plates connected to the top flange 17 of channel part 16 and its other plate positioned overlying the upper front margin 20 of panel 10. Each of the hinge parts is connected to the upper front margin 20 of panel 10 by a screw 22 which extends through aligned openings in the panel and hinge plate from the rear of the panel and over which is threaded a protruding stud 24 which is turned down against the hinge plate as best illustrated in FIGS. 4 and 7 of the drawings.

Each of the studs 24 protrude forwardly from panel 10 and serve as pins over which sheet material 26 is applied in customary fashion. In this manner, sheet material 26, which may be in the form of a padded material, is suspended from the upper front margin 20 of panel 10.

Figure 2:
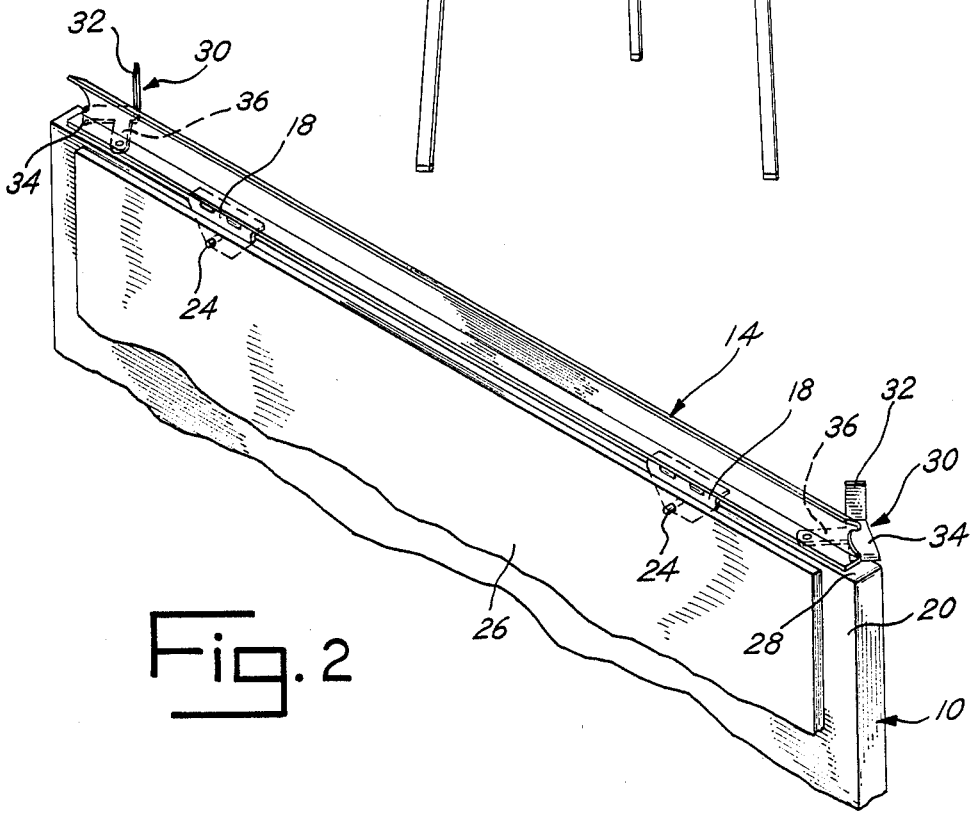
FIG. 2 is a fragmentary detailed view of the easel showing the sheet material retainer of this invention in its raised or open position to expose the sheet material.

Retainer 14 is pivotal about its hinge parts 18 from its lowered or down position overlying the upper margin of sheet material 26 as it is suspended on panel 10 as illustrated in FIG. 4 and a raised or upper position resting upon the upper edge 28 of panel 10 to expose the upper margin of sheet material 26 as illustrated in FIG. 2. When in its upper or raised position, retainer 14 is self-supported by panel 10 so as to enable the user of the easel to remove sheet material 26 and to replace it with other sheet material with both hands.

Retainer 14 is maintained in its down position by lock members 30. While a single lock member 30 would suffice to maintain retainer in its down position, it is preferable that two lock members be utilized, one at each end of the retainer, as will be described. Each lock member 30 includes a leg 32 to which is integrally connected at its upper edge a shoulder 34. Leg 32 and connected shoulder 34 preferbaly extend at a right angle to each other. A tab 36 extends from shoulder 34 of each lock member 30. Each lock member 30 is pivotally connected at its tab 36 by a rivet 38 or similar securement device to the top flange 17 of retainer channel part 16.

Each lock member 30 can be pivoted relative to retainer 14 from a closed position, best illustrated in FIG. 5, in which leg 32 of the lock member adjacently overlies the front of channel part 16 of the retainer and the shoulder 34 of the lock member extends across flange 17 of the channel part and adjacently overlies upper edge 28 of panel 10. In this closed position of either lock member 30, retainer 14 is prevented from being lifted or raised from its lowered position due to the interference between the overlying lock member shoulder 34 and panel 10 at its upper edge 28. Each lock member 30 can be shifted from its closed position shown in FIG. 5 into its open position shown in FIG. 6 in which the lock member is pivoted inwardly relative to retainer 14 so as to move shoulder 34 of each lock member from over upper edge 28 of the panel, thereby freeing retainer 14 for movement from its lowered position into its raised position shown in FIGS. 2 and 3. Each end edge of retainer 14 is cut away at 42 so as to provide a retainer-free area by which leg 32 of each lock member can be grasped with the fingers of the easel user to pivot each lock member between its closed and open positions.

When in its secured down or lowered position shown in FIG. 4, with each lock member 30 in its closed position as shown in FIGS. 5 and 7, the retainer will overlie the upper margin of any sheet material 26 supported upon the panel by studs 24 with the lower edge 44 of the retainer being inset towards panel 10 from the plane of the ends of studs 24 so as to prevent the sheet material from being removed from the panel. It is not necessary that retainer 10 contact the underlying sheet material when in its secured lowered position.

Retainer 14 is adapted for mounting to a variety of panels 10 or even to easels which utilize no panel but simply an upper transverse frame part to which the sheet material may be suspended. Also, retainer 14 which includes its hinge parts 18 and lock members 30 is adapted to be mounted to existing easels in the place of the afore-described previously constructed clamp or screw securement type of retainer.

Accordingly, it is to be understood that the aforedescription is not intended to limit the invention to the abovegiven details but may be modified in accordance with the following claims.

What I claim is:

1. An easel having legs supporting an upper transverse member, means carried at said upper transverse member for supporting sheet material at the sheet material's upper margin, an elongated sheet material retainer extending along said transverse member and being pivotally secured to the transverse member so as to be swingable relative to the transverse member between a lowered position overlying said sheet material at its upper margin when supported by the transverse part and a raised position to expose said sheet material upper margin to allow the sheet material to be separated from the transverse member, the improvement comprising a locking member pivotally mounted to said retainer and being movable between an open position permitting said retainer to swing into its said raised position and a closed position preventing said retainer from being swung into its said raised position, said transverse member including an upper edge, said retainer including an upper flange, said locking member being pivotally connected to said retainer at its said upper flange and including a shoulder part positioned adjacently over said transverse member upper edge when the locking member is in its closed position, said shoulder part constituting means for engaging said transverse member only at its said upper edge as the retainer is being swung toward its said raised position to prevent upward movement of the retainer into its said raised position, said shoulder part being shiftable entirely from over said transverse member upper edge when the locking member is in its open position.

2. The easel of claim 1 wherein said retainer includes opposite ends, said locking member attached at one of said ends and including a depending leg overlying said retainer, said leg constituting means for the user to grasp to pivot said locking member between its open and closed positions.

3. The easel of claim 2 wherein said leg constitutes stop means for locating said shoulder part over said transverse member upper edge.

4. The easel of claim 3 wherein a second said locking member is so pivotally mounted to said retainer at the opposite said end of the retainer.

5. The easel of claim 1 and a panel supported by said legs, said transverse member constituting a part of said panel.

6. The easel of claim 5 wherein said retainer includes a hinge having a plate overlying said panel, a screw member extending from said panel through said plate, a pin threaded onto said screw member and against said plate to secure the plate to the panel, said pin constituting means for supporting said sheet material.

7. A retainer for sheet material used with an easel panel, said retainer comprising an elongated channel member and connected hinge means for securement to the panel at the upper margin thereof, a locking member pivotally mounted to said channel member and being movable between a raised open position permitting the channel member to swing between a raised position to expose the sheet material for removal when the channel member is secured to the panel by said hinge means and a lowered closed position preventing the channel member from swinging into its said raised position, said channel member including an upper flange, said locking member pivotally connected to said channel member upper flange and including a shoulder part means for positioning adjacently over said panel when the locking member is in its closed position to engage the panel at its upper edge only upon attempted upward movement of the channel member into its said open position.

8. The retainer of claim 7 wherein said channel member includes opposite ends, said locking member located at one of said ends and including a depending leg overlying said channel member, said leg constituting means the user may grasp to pivot said locking member between its closed and open positions.

9. The retainer of claim 8 wherein said leg constitutes stop means for locating said shoulder part over said channel member upper flange.

10. The retainer of claim 8 and a second said locking member so pivotally mounted to said channel member at its opposite said end.

* * * * *